US011404759B2

(12) United States Patent
Ito

(10) Patent No.: US 11,404,759 B2
(45) Date of Patent: Aug. 2, 2022

(54) CONNECTION STRUCTURE INCLUDING A COUPLING WINDOW BETWEEN A DIELECTRIC WAVEGUIDE LINE IN A SUBSTRATE AND A WAVEGUIDE AND HAVING PLURAL RECESSES FORMED IN THE CONNECTION STRUCTURE

(71) Applicant: NEC Corporation, Tokyo (JP)

(72) Inventor: Masaharu Ito, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/058,356

(22) PCT Filed: May 9, 2019

(86) PCT No.: PCT/JP2019/018499
§ 371 (c)(1),
(2) Date: Nov. 24, 2020

(87) PCT Pub. No.: WO2019/235120
PCT Pub. Date: Dec. 12, 2019

(65) Prior Publication Data

US 2021/0119314 A1 Apr. 22, 2021

(30) Foreign Application Priority Data

Jun. 4, 2018 (JP) ..... JP2018-106896

(51) Int. Cl.
*H01P 5/02* (2006.01)
*H01P 3/02* (2006.01)
(Continued)

(52) U.S. Cl.
CPC ..... *H01P 5/024* (2013.01); *H01P 3/026* (2013.01); *H01P 3/08* (2013.01); *H01P 3/12* (2013.01);
(Continued)

(58) Field of Classification Search
CPC ..... H01P 3/121; H01P 5/087; H01P 5/024
(Continued)

(56) References Cited

U.S. PATENT DOCUMENTS

2018/0226709 A1* 8/2018 Mangaiahgari ..... H01P 3/121
2019/0245257 A1* 8/2019 Foroozesh et al. .. H05K 1/0242

FOREIGN PATENT DOCUMENTS

JP H07-307601 A 11/1995
JP 10-107518 A 4/1998
(Continued)

OTHER PUBLICATIONS

International Search Report of PCT/JP2019/018499 dated Jun. 11, 2019 [PCT/ISA/210].
(Continued)

*Primary Examiner* — Benny T Lee
(74) *Attorney, Agent, or Firm* — Sughrue Mion, PLLC

(57) ABSTRACT

A connection structure includes a dielectric waveguide line and a rectangular waveguide. The dielectric waveguide line transmits a high-frequency signal in a transmission region surrounded by a first conductor layer, a second conductor layer, and two arrays of via hole groups. A coupling window is formed in the second conductor layer. The rectangular waveguide is disposed in such a way that an open end surface of the rectangular waveguide faces the coupling window, and that the transmission direction of the dielectric waveguide line becomes orthogonal to the transmission direction of the rectangular waveguide. A plurality of recesses are formed on a first substrate surface in the vicinity of the coupling window. A recessed conductor layer electrically connected to the first conductor layer is formed on inner wall surfaces of the plurality of recesses.

9 Claims, 11 Drawing Sheets

(51) Int. Cl.

| | |
|---|---|
| ***H01P 3/08*** | (2006.01) |
| ***H01P 3/12*** | (2006.01) |
| ***H01P 3/16*** | (2006.01) |
| ***H01P 5/08*** | (2006.01) |

(52) U.S. Cl.
CPC ..... *H01P 3/121* (2013.01); *H01P 3/16* (2013.01); *H01P 5/08* (2013.01)

(58) Field of Classification Search
USPC ..... 333/21 R
See application file for complete search history.

(56) References Cited

FOREIGN PATENT DOCUMENTS

| | | | |
|---|---|---|---|
| JP | 2000-196301 | A | 7/2000 |
| JP | 2001-185916 | A | 7/2001 |
| JP | 2005-012699 | A | 1/2005 |
| JP | 2015-080100 | A | 4/2015 |

OTHER PUBLICATIONS

Written Opinion of PCT/JP2019/018499 dated Jun. 11, 2019 [PCT/ISA/237].
Japanese Office Action for JP Application No. 2020-523575 dated Jun. 22, 2021 with English Translation.

* cited by examiner

CONNECTION STRUCTURE INCLUDING A COUPLING WINDOW BETWEEN A DIELECTRIC WAVEGUIDE LINE IN A SUBSTRATE AND A WAVEGUIDE AND HAVING PLURAL RECESSES FORMED IN THE CONNECTION STRUCTURE

CROSS REFERENCE TO RELATED APPLICATIONS

This application is a National Stage of International Application No. PCT/JP2019/018499 filed on May 9, 2019, claiming priority based on Japanese Patent Application No. 2018-106896 filed on Jun. 4, 2018, the entire disclosure of which is incorporated herein.

TECHNICAL FIELD

The present disclosure relates to a connection structure between a dielectric waveguide line and a waveguide.

BACKGROUND ART

Recently, communication traffic has increased rapidly due to the expansion of large-capacity communication applications such as streaming video in addition to the increase in the number of terminals because of the spread of mobile terminal devices such as smartphones. Under such circumstances, it is expected to achieve large-capacity communication using the sub-terahertz band having a wide frequency band. The sub-terahertz band here generally refers to a frequency band of 100 GHz or more.

In a high frequency band module such as a millimeter wave band according to related art, LTCC (Low Temperature Co-fired Ceramics), which is easy to be multilayered and has a high degree of freedom in design, is widely used. Resin substrates are often used, because the loss of the material is inherently low and transmission loss of the resin substrate is also low because of a low dielectric constant (reduction of wavelength shortening effect). The resin substrate is PTFE (PolyTetraFluoroEthylene), LCP (Liquid Crystal Polymer), or the like.

Since the wavelength is very small in the sub-terahertz band, higher processing accuracy is required for a transmission line or the like of a high-frequency signal. Further, there is no room in gain performance of a semiconductor element such as an amplifier, and thus it is important to transmit a high frequency signal more efficiently. Thus, it is desirable that the loss of materials used for the package be low. Since the dimensional accuracy of LTCC, which is commonly used in the millimeter wave band, is not very high and the loss thereof is relatively large, it is difficult to employ LTCC in the sub-terahertz band. On the other hand, although the loss of the resin substrate is low, the resin substrate has low rigidity, the methods of mounting the resin substrate are limited, and the dimensional accuracy of the resin substrate is not very high, which makes it difficult to employ the resin substrate in the sub-terahertz band as well.

Quartz is known as a substrate material having high rigidity, easy to achieve high dimensional accuracy, low loss, and low dielectric constant. However, since the formation of via holes is difficult, the use of the via holes has been limited, and thus the via holes have not been widely used. Recently, the progress of the technique for forming via holes has enabled fine via holes to be formed with high accuracy, which results in an increase in the use of quartz for millimeter-wave band packages.

When a high antenna gain is required for long-distance transmission in wireless communication, an antenna having a waveguide interface such as a cassegrain antenna or a lens antenna is commonly used. In this case, it is important to efficiently transmit the high-frequency signal from the package to the waveguide.

Patent Literature 1 (Japanese Unexamined Patent Application Publication No. 2000-196301) describes a structure for connecting a dielectric waveguide line to a rectangular waveguide using a dielectric waveguide line having low loss as compared with a transmission line having a planar structure such as a microstrip line or a coplanar line as a transmission line on a package. The dielectric waveguide line structure is formed by connecting conductor surfaces formed on both top and bottom surfaces of a dielectric substrate by two via hole arrays. Each via hole array is composed of via holes formed at spacings of ½ or less of the guide wavelength, and functions equivalently as a waveguide sidewall surface. Here, the guide wavelength $\lambda_g$ is $\lambda/\sqrt{(1-(\lambda/\lambda_c)^2)}$. Here, $\lambda$ is $1/\sqrt{(\varepsilon_r)}$ of a vacuum wavelength of an operating frequency signal, $\varepsilon_r$ is a dielectric constant of a dielectric substrate, and $\lambda_c$ is a cutoff wavelength (which is two times the width of the dielectric waveguide line in TE_10 mode) of the dielectric waveguide line.

An opening for coupling is provided in one of the top and bottom conductor surfaces of one end of the dielectric waveguide line, and a rectangular waveguide is connected to the opening in the vertical direction. The transmission of electromagnetic waves between the dielectric waveguide line and the rectangular waveguide is achieved by electric field coupling through the opening for coupling. Since the thickness of the dielectric substrate of the dielectric waveguide line is set to ¼ of the guide wavelength, the electric field intensity reaches its maximum at the opening for coupling. Thus, efficient transmission of electromagnetic waves between the dielectric waveguide line and the rectangular waveguide is achieved.

SUMMARY OF THE INVENTION

Technical Problem

Patent Literature 1 describes an example of manufacturing a dielectric waveguide line using a multilayer ceramic technology. The thickness of the dielectric waveguide line is adjusted by the number of layers of the green sheet to be laminated. Further, a green sheet may be laminated on a surface of a substrate on which the dielectric waveguide line is formed, which is the surface opposite to the surface in which the opening for coupling is formed. If this dielectric waveguide line is applied to the sub-terahertz band, even when the thickness of the dielectric waveguide line is very small, the thickness of the entire substrate can be increased, which enables the strength of the entire substrate to be sufficient. However, it is difficult to use this dielectric waveguide line in terms of transmission loss.

On the other hand, when a dielectric waveguide line is formed using quartz, which is expected to be used in a sub-terahertz band, for example, in a dielectric waveguide line having a cross-sectional shape with a lateral width of 0.75 mm, ¼ of the guide wavelength at 160 GHz becomes 0.31 mm, which is very small. Since quartz is rigid and easily cracked, the optimum thickness of a quartz substrate, which is difficult to be multilayered, becomes very small, and thus ensuring the strength of the substrate has been a problem.

An object of the present disclosure is to provide a connection structure that solves any of the foregoing problems.

Solution to the Problem

According to the present disclosure, a connection structure between a dielectric waveguide line and a waveguide is provided. The dielectric waveguide line includes: a first dielectric substrate including a first substrate surface and a second substrate surface opposite to the first substrate surface; a first conductor layer disposed on the first substrate surface; a second conductor layer disposed on the second substrate surface; and two arrays of through conductor groups composed of a plurality of through conductors formed in a transmission direction of the dielectric waveguide line at spacings of ½ or less of a dielectric guide wavelength as a guide wavelength of a high-frequency signal in the dielectric waveguide line, the two arrays of through conductor groups electrically connecting the first conductor layer to the second conductor layer and being formed apart from each other in a direction orthogonal to the transmission direction, and a transmission region, in which the high-frequency signal propagates, being formed surrounded by the first conductor layer, the second conductor layer, and the two arrays of through conductor groups. A coupling window is formed in the second conductor layer. The waveguide is disposed in such a way that an open end surface of the waveguide faces the coupling window, and that the transmission direction of the dielectric waveguide line becomes orthogonal to the transmission direction of the waveguide. A plurality of recesses are formed in the first substrate surface in the vicinity of the coupling window. A recessed conductor layer electrically connected to the first conductor layer is formed on inner wall surfaces of the plurality of recesses.

Advantageous Effects of the Invention

According to the present disclosure, in the connection structure between the dielectric waveguide line and the waveguide, by forming a local recess in the dielectric substrate without thinning the entire dielectric substrate, satisfactory transmission characteristics can be achieved while ensuring mechanical strength of the dielectric substrate.

DETAILED DESCRIPTION OF THE EMBODIMENTS

First Example Embodiment

Figure 1:
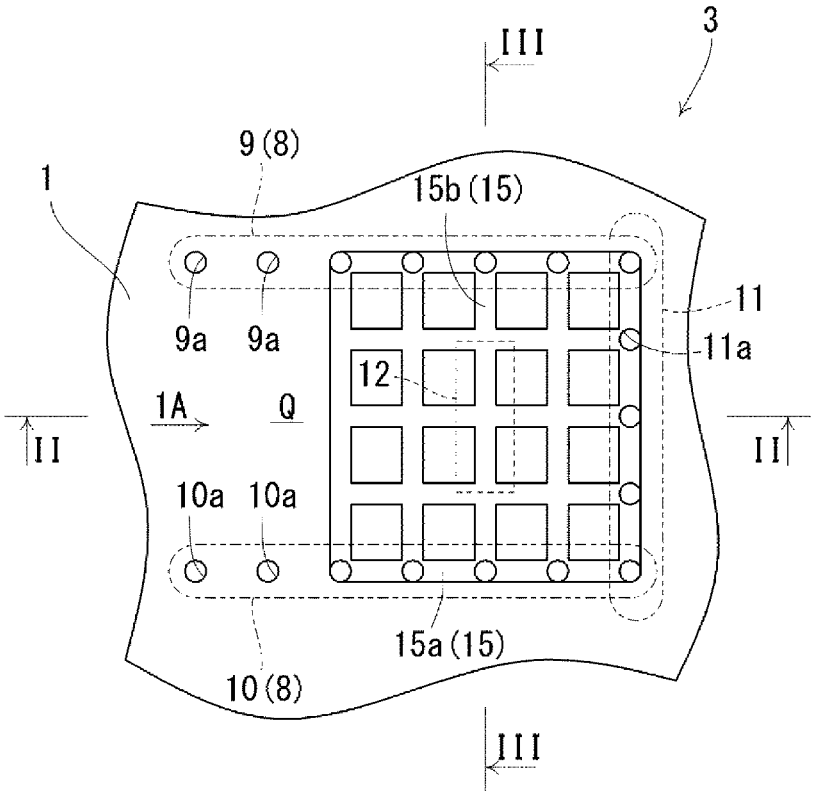
FIG. 1 is a plan view of a connection structure according to a first example embodiment.
Figure 2:
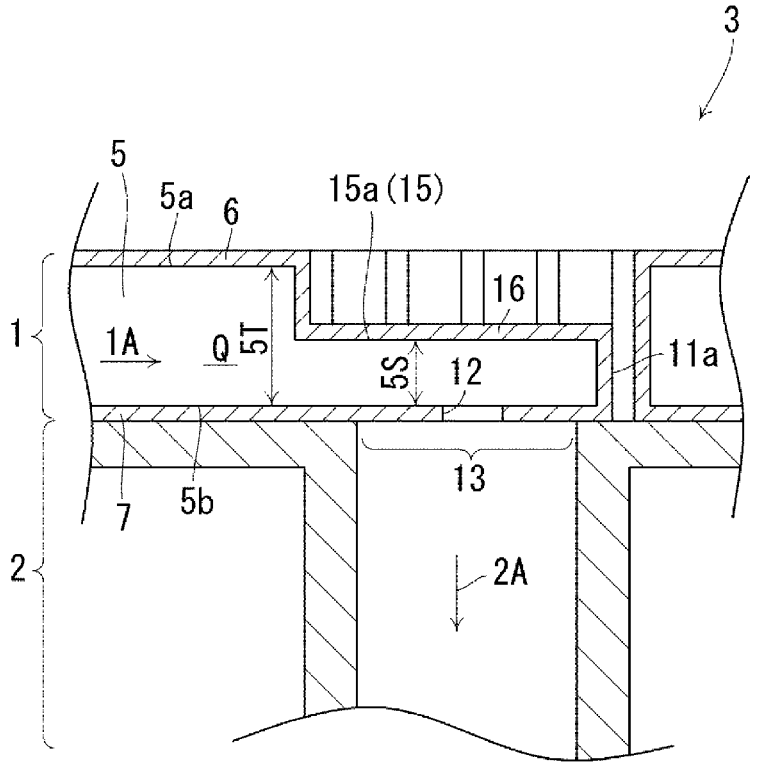
FIG. 2 is a cross-sectional view taken along the line II-II of FIG. 1.
Figure 3:
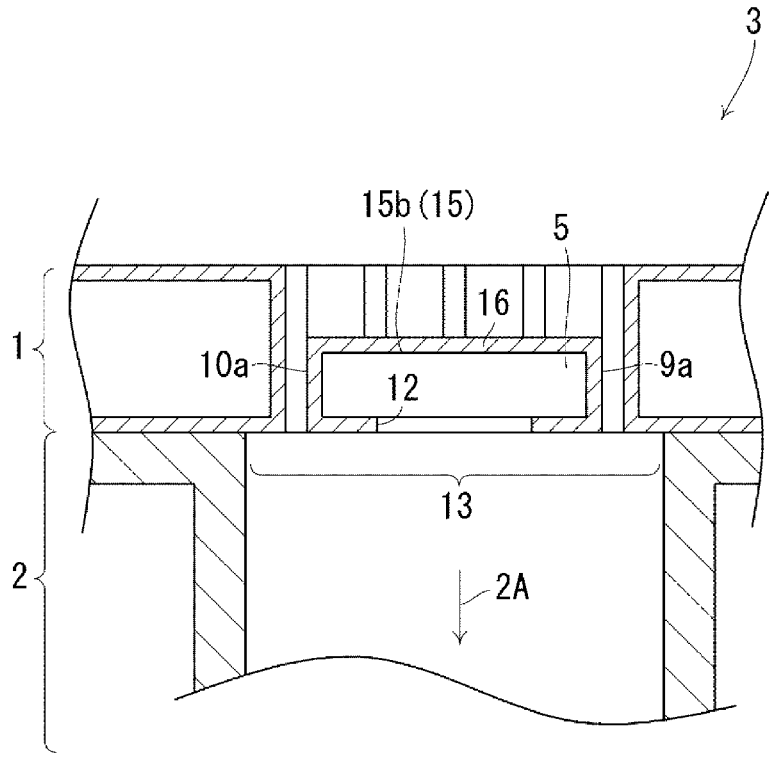
FIG. 3 is a cross-sectional view taken along the line of FIG. 1.

Hereinafter, a first example embodiment will be described with reference to FIGS. 1 to 3. FIG. 1 is a plan view of a connection structure according to the first example embodiment. FIG. 2 is a cross-sectional view taken along the line II-II of FIG. 1. FIG. 3 is a cross-sectional view taken along the line of FIG. 1.

FIGS. 1 to 3 show a connection structure 3 between a dielectric waveguide line 1 and a rectangular waveguide 2 (FIGS. 2 and 3). As shown in FIG. 2, the connection structure 3 includes a dielectric waveguide line 1 and a rectangular waveguide 2. The dielectric waveguide line 1 and the rectangular waveguide 2 are connected to each other in such a way that a transmission direction 1A of an operating frequency signal in the dielectric waveguide line 1 becomes orthogonal to a transmission direction 2A of a operating frequency signal in the rectangular waveguide 2. The operating frequency signal is a specific example of a high frequency signal.

As shown in FIGS. 1 and 2, the dielectric waveguide line 1 includes a first dielectric substrate 5, a first conductor layer 6, a second conductor layer 7 as shown in FIG. 2, and two arrays of via hole groups 8 as shown in FIG. 1.

The first dielectric substrate 5 is, for example, quartz. As shown in FIG. 2, the first dielectric substrate 5 includes a first substrate surface 5*a* facing upward and a second substrate surface 5*b* facing downward on a surface opposite to the first substrate surface 5*a*. A thickness 5T of the first dielectric substrate 5 is, for example, 0.35 millimeters.

The first conductor layer 6 is a conductor layer disposed on the first substrate surface 5*a* of the first dielectric substrate 5. The second conductor layer 7 is a conductor layer disposed on the second substrate surface 5*b* of the first dielectric substrate 5. The first conductor layer 6 and the second conductor layer 7 are made of, for example, copper. The thickness of the first conductor layer 6 and the second conductor layer 7 is, for example, 20 micrometers.

The two arrays of via hole groups 8 are specific examples of the two arrays of conductor through-hole groups. As shown in FIG. 1, the two arrays of via hole groups 8 include a first via hole group 9 and a second via hole group 10.

The first via hole group 9 includes a plurality of via holes 9*a*. The plurality of via holes 9*a* are arranged at predetermined spacings along the transmission direction 1A of the dielectric waveguide line 1. The plurality of via holes 9*a* electrically connect the first conductor layer 6 to the second conductor layer 7. The above predetermined spacing is ½ or less of a dielectric guide wavelength as a guide wavelength of the operating frequency signal in the dielectric waveguide line 1. Note that the guide wavelength $\lambda_g$ is calculated by $\lambda/\sqrt{(1-(\lambda/\lambda_c)^2)}$. Here, $\lambda$ is $1/\sqrt{(\varepsilon_r)}$ of a vacuum wavelength of an operating frequency signal, $\varepsilon_r$ is a dielectric constant of a dielectric substrate, and $\varepsilon_c$ is a cutoff wavelength (which is two times the width of the dielectric waveguide line in TE_10 mode) of the dielectric waveguide line.

The second via hole group 10 includes a plurality of via holes 10*a*. The plurality of via holes 10*a* are arranged at the above predetermined spacings along the transmission direction 1A of the dielectric waveguide line 1. The plurality of via holes 10*a* electrically connect the first conductor layer 6 to the second conductor layer 7.

The first via hole group 9 and the second via hole group 10 are formed to extend along the transmission direction 1A of the dielectric waveguide line 1. The first via hole group 9 and the second via hole group 10 are formed to be parallel to each other. The first via hole group 9 and the second via hole group 10 are formed apart from each other in a direction orthogonal to the transmission direction 1A of the dielectric waveguide line 1 in a plan view shown in FIG. 1.

The first via hole group 9 and the second via hole group 10 function equivalently as a waveguide sidewall. Thus, a transmission region Q surrounded by the first conductor layer 6, the second conductor layer 7, and two arrays of the via hole groups 8 is defined. The operating frequency signal is transmitted in the transmission region Q.

As shown in FIG. 1, the dielectric waveguide line 1 includes a third via hole group 11. The third via hole group 11 includes a plurality of via holes 11*a*. The plurality of via holes 11*a* are arranged at the above predetermined spacings along the direction orthogonal to the transmission direction 1A of the dielectric waveguide line 1 in the plan view shown in FIG. 1. The plurality of via holes 11*a* electrically connect the first conductor layer 6 to the second conductor layer 7. Thus, the third via hole group 11 functions as a short-circuit termination of the transmission region Q.

As shown in FIGS. 1 to 3, a coupling window 12 is formed in the second conductor layer 7 (FIGS. 2 and 3). The coupling window 12 is an opening in the second conductor layer 7. As shown in FIG. 1, the coupling window 12 is formed in a rectangular shape which is narrow in the transmission direction 1A of the dielectric waveguide line 1 and wide in the direction orthogonal to the transmission direction 1A of the dielectric waveguide line 1. The coupling window 12 is formed in the vicinity of the third via hole group 11. The coupling window 12 is formed on the upstream side of the transmission direction 1A of the dielectric waveguide line 1 as viewed from the third via hole group 11. As shown in FIGS. 2 and 3, the rectangular waveguide 2 is disposed in such a way that an open end surface 13 of the rectangular waveguide 2 faces the coupling window 12. The rectangular waveguide 2 is disposed in such a way that at least a part of the open end surface 13 of the rectangular waveguide 2 faces the coupling window 12. The rectangular waveguide 2 is disposed in such a way that the coupling window 12 is inside the open end surface 13. The operating frequency signal is transmitted between the dielectric waveguide line 1 and the rectangular waveguide 2 through the coupling window 12.

Returning to FIG. 1, a plurality of recesses 15 are formed in the first substrate surface 5*a* of the first dielectric substrate 5 in the vicinity of the coupling window 12. The plurality of recesses 15 include a plurality of transmission-direction translational recesses 15*a* and a plurality of transmission-direction orthogonal recesses 15*b*.

The plurality of transmission-direction translational recesses 15*a* extend along the transmission direction 1A of the dielectric waveguide line 1. The plurality of transmission-direction orthogonal recesses 15*b* extend along the direction in which the two arrays of the via hole groups 8 of face each other. The plurality of transmission-direction translational recesses 15*a* and the plurality of transmission-direction orthogonal recesses 15*b* are formed in a lattice shape.

Specifically, the plurality of transmission-direction translational recesses 15*a* are formed at the above predetermined spacings in the direction in which the two arrays of via hole groups 8 face each other. The plurality of transmission-direction translational recesses 15*a* are formed parallel to each other. The plurality of transmission-direction translational recesses 15*a* are formed apart from each other.

Similarly, the plurality of transmission-direction orthogonal recesses 15*b* are formed at the above predetermined spacings in the transmission direction 1A of the dielectric waveguide line 1. The plurality of transmission-direction orthogonal recesses 15*b* are formed parallel to each other. The plurality of transmission-direction orthogonal recesses 15*b* are formed apart from each other. The transmission-direction orthogonal recess 15*b* on the most downstream side in the transmission direction 1A among the plurality of transmission-direction orthogonal recesses 15*b* of the dielectric waveguide line 1 is formed so as to overlap with the third via hole group 11.

As shown in FIGS. 2 and 3, a recessed conductor layer 16 electrically connected to the first conductor layer 6 is formed on inner wall surfaces of the plurality of recesses 15. The recessed conductor layer 16 is formed, for example, by plating.

As described above, by forming the plurality of transmission-direction translational recesses 15*a* at the above predetermined spacings, the plurality of transmission-direction translational recesses 15*a* function equivalently as an upper surface of the waveguide for the operating frequency signal. The same applies to the plurality of transmission-direction orthogonal recesses 15*b*. It is desirable that the above predetermined spacings be ¼ or less of the dielectric guide wavelength in order to make the bottom surfaces of the plurality of recesses 15 function as substantially uniform conductor surfaces equivalently.

By forming the plurality of recesses 15 in this manner, it is possible to make the thickness of the first dielectric substrate 5 in the vicinity of the coupling window 12 approximately ¼ of the dielectric guide wavelength, which is equivalently optimum, without reducing the thickness of the entire first dielectric substrate 5 in the vicinity of the coupling window 12. In this example embodiment, as shown in FIG. 2, a distance 5S between bottom surfaces of the plurality of recesses 15 and the second substrate surface 5*b* is set to ¼ of the dielectric guide wavelength. In particular, the thickness of the first dielectric substrate 5 in the vicinity of the coupling window 12 dominantly contributes to the transmission characteristics of the connection structure between the dielectric waveguide line 1 and the rectangular waveguide 2.

Further, since the plurality of recesses 15 are formed in the lattice shape, the mechanical strength of the first dielectric substrate 5 can be ensured as compared with the case where the first dielectric substrate 5 is made uniformly thin in the vicinity of the coupling window 12.

Here, for example, an example of a method of forming a plurality of recesses 15 when the first dielectric substrate 5 is made of quartz will be described. In order to form each of the recesses 15, a via hole not penetrating the first dielectric substrate 5 may be formed a plurality of times at a pitch of a radius of the via hole.

Next, an example of a method of forming the via hole will be described.

(1) First, a locus part of a focal point of a quartz substrate is modified by irradiating a center position of the via hole with a femtosecond laser and scanning the focal point.

(2) Next, the quartz substrate is treated with hydrofluoric acid. Then, the modified part of the quartz substrate is selectively and preferentially etched, and then etched isotropically and gently. By doing so, non-penetrating via holes are formed in the quartz substrate.

(3) When the via hole is formed a plurality of times at the pitch of about the radius of the via holes, the adjacent via holes are connected to each other in an isotropic etching process to thereby form the recesses 15 extending in a predetermined direction.

(4) When the locus of the focal point is formed so as to penetrate through the quartz substrate, a through via hole can be formed.

As described above, the connection structure 3 between the dielectric waveguide line 1 and the rectangular waveguide 2 (waveguide) includes the dielectric waveguide line 1 and the rectangular waveguide 2. The dielectric waveguide line 1 includes the first dielectric substrate 5 having the first substrate surface 5*a* and the second substrate surface 5*b* opposite to the first substrate surface 5*a*. The dielectric waveguide line 1 includes the first conductor layer 6 disposed on the first substrate surface 5*a* and the second conductor layer 7 disposed on the second substrate surface 5*b*. The dielectric waveguide line 1 includes the two arrays of via hole groups 8 (through conductor group). The two arrays of via hole groups 8 are formed by forming a plurality of via holes 9*a* and via holes 10*a* (through conductors) in the transmission direction 1A of the dielectric waveguide line 1 at spacings of ½ or less of the dielectric guide wavelength as the guide wavelength of the high-frequency signal in the dielectric waveguide line 1. The two arrays of via hole groups 8 electrically connect the first conductor layer 6 to the second conductor layer 7. The two arrays of via hole groups 8 are formed apart from each other in the direction orthogonal to the transmission direction 1A. The dielectric waveguide line 1 transmits the high frequency signal in the transmission region Q surrounded by the first conductor layer 6, the second conductor layer 7, and the two arrays of via hole groups 8 (through conductor group). The coupling window 12 is formed in the second conductor layer 7. The rectangular waveguide 2 is disposed in such a way that the open end surface 13 of the rectangular waveguide 2 faces the coupling window 12 and the transmission direction 1A of the dielectric waveguide line 1 becomes orthogonal to the transmission direction 2A of the rectangular waveguide 2. The plurality of recesses 15 are formed in the first substrate surface 5*a* in the vicinity of the coupling window 12. The recessed conductor layer 16 electrically connected to the first conductor layer 6 is formed on the inner wall surfaces of the plurality of recesses 15.

According to the above-described configuration, the local recesses 15 are formed in the first dielectric substrate 5 without reducing the thickness of the entire first dielectric substrate 5, thereby achieving satisfactory transmission characteristics while ensuring the mechanical strength of the first dielectric substrate 5.

Second Example Embodiment

Next, a second example embodiment will be described with reference to FIG. 4. Hereinafter, a difference between this example embodiment and the first example embodiment will be mainly described, and the repeated description will be omitted.

Figure 4:
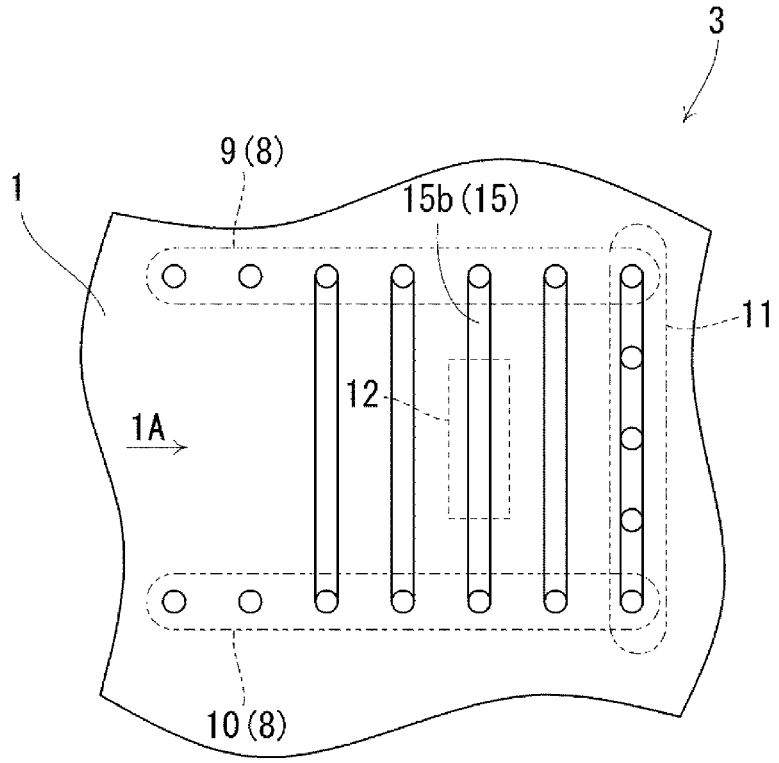
FIG. 4 is a plan view of a connection structure according to a second example embodiment.

As shown in FIG. 4, in this example embodiment, the plurality of recesses 15 do not include the plurality of transmission-direction translational recesses 15*a* as shown in FIG. 1, and instead include only the plurality of transmission-direction orthogonal recesses 15*b*. The plurality of transmission-direction orthogonal recesses 15*b* are formed in the vicinity of the coupling window 12. Thus, the area where the plurality of recesses 15 are formed is smaller as compared with the first example embodiment, and thus the uniformity of the function as the upper surface of the waveguide is deteriorated, but productivity and mechanical strength can be improved.

Third Example Embodiment

Next, a third example embodiment will be described with reference to FIG. 5. Hereinafter, a difference between this example embodiment and the first example embodiment will be mainly described, and the repeated description will be omitted.

Figure 5:
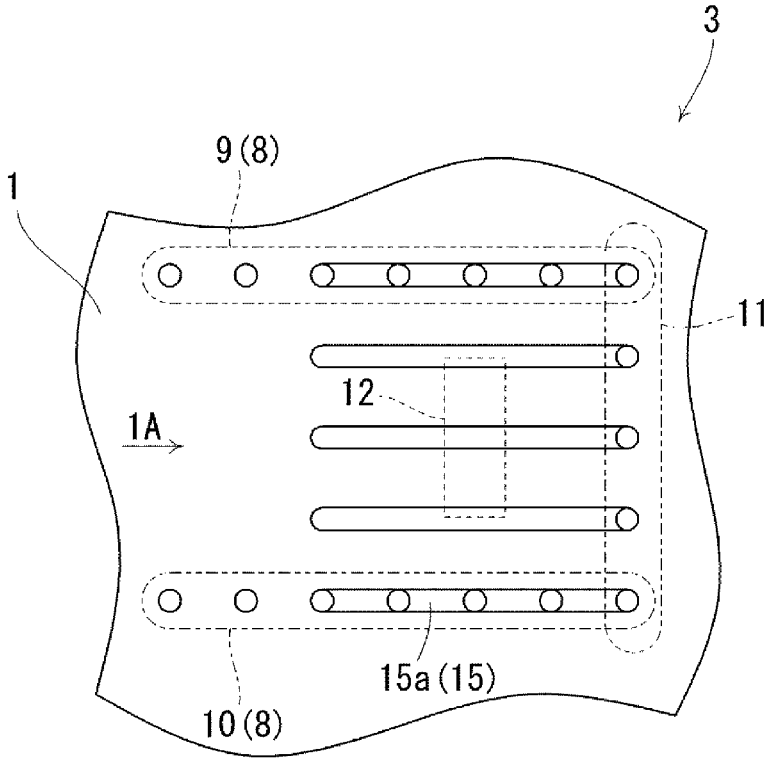
FIG. 5 is a plan view of a connection structure according to a third example embodiment.

As shown in FIG. 5, in this example embodiment, the plurality of recesses 15 do not include the plurality of transmission-direction orthogonal recesses 15*b* as shown in FIG. 1, and instead include only the plurality of transmission-direction translational recesses 15*a*. The plurality of transmission-direction translational recesses 15*a* are formed in the vicinity of the coupling window 12. Thus, the area where the plurality of recesses 15 are formed is smaller as compared with the first example embodiment, and thus the uniformity of the function as the upper surface of the waveguide is deteriorated, but productivity and mechanical strength can be improved.

Fourth Example Embodiment

Next, a fourth example embodiment will be described with reference to FIG. 6. Hereinafter, a difference between this example embodiment and the first example embodiment will be mainly described, and the repeated description will be omitted.

In the first example embodiment, the plurality of recesses 15 include the plurality of transmission-direction translational recesses 15*a* and the plurality of transmission-direction orthogonal recesses 15*b*.

Figure 6:
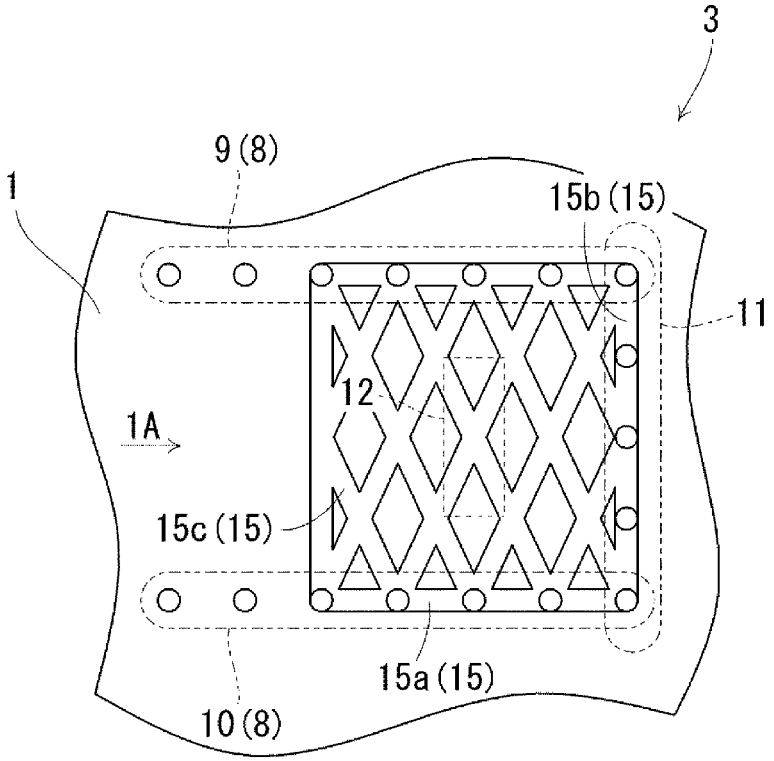
FIG. 6 is a plan view of a connection structure according to a fourth example embodiment.

On the other hand, in this example embodiment, the plurality of recesses 15 include a plurality of transmission-direction oblique recesses 15*c* extending obliquely with respect to the transmission direction 1A of the dielectric waveguide line 1 in a plan view shown in FIG. 6. The plurality of transmission-direction oblique recesses 15*c* are formed in the vicinity of the coupling window 12. The plurality of transmission-direction oblique recesses 15*c* are formed in a lattice shape.

Some of the transmission-direction oblique recesses 15*c* among the plurality of transmission-direction oblique recesses 15*c* are formed parallel to each other and at the above predetermined spacings.

Further, the recesses 15 further include two transmission-direction translational recesses 15*a* and two transmission-direction orthogonal recesses 15*b* so as to surround the plurality of transmission-direction oblique recesses 15*c* formed in the lattice shape. The two transmission-direction translational recesses 15*a* and the two transmission-direction orthogonal recesses 15*b* are formed in a rectangular shape so as to surround the plurality of transmission-direction oblique recesses 15*c*.

Fifth Example Embodiment

Next, a fifth example embodiment will be described with reference to FIG. 7. Hereinafter, a difference between this example embodiment and the first example embodiment will be mainly described, and the repeated description will be omitted.

In the first example embodiment as shown in FIG. 1, the plurality of recesses 15 include the plurality of transmission-direction translational recesses 15*a* and the plurality of transmission-direction orthogonal recesses 15*b*.

Figure 7:
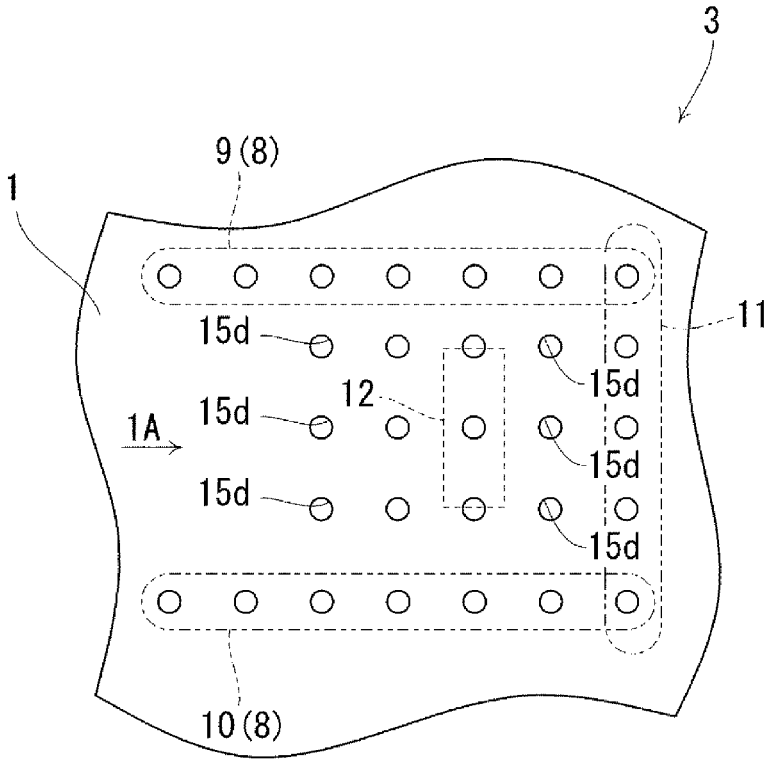
FIG. 7 is a plan view of a connection structure according to a fifth example embodiment.

On the other hand, in this example embodiment, as shown in FIG. 7, the plurality of recesses 15 include a plurality of cylindrical recesses 15*d* extending in shapes of cylinders from the first conductor layer 6 toward the second conductor layer 7. The plurality of cylindrical recesses 15*d* are formed in the vicinity of the coupling window 12. The plurality of cylindrical recesses 15*d* are formed in a matrix shape. The plurality of cylindrical recesses 15*d* are non-penetrating via holes. Thus, the area where the plurality of recesses 15 are formed is smaller as compared with the first example embodiment, and thus the uniformity of the function as the upper surface of the waveguide is deteriorated, but productivity and mechanical strength can be improved.

Sixth Example Embodiment

Figure 8:
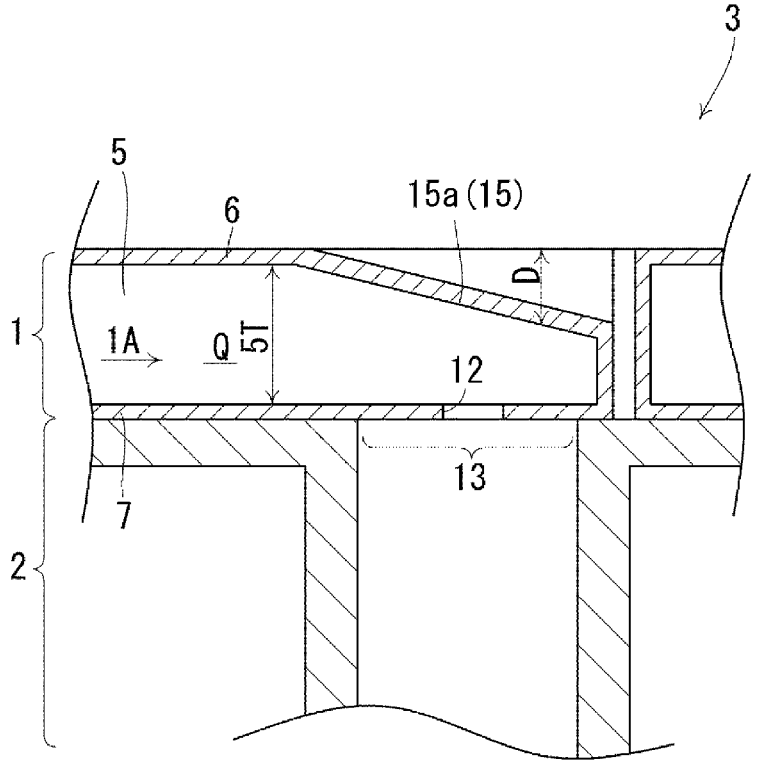
FIG. 8 is a cross-sectional view of a connection structure according to a sixth example embodiment.

Next, a sixth example embodiment will be described with reference to FIG. 8. Hereinafter, a difference between this example embodiment and the first example embodiment will be mainly described, and the repeated description will be omitted.

In this example embodiment, a depth D of each of the plurality of recesses 15 is gradually increased toward the transmission direction 1A of the dielectric waveguide line 1. In this configuration, the thickness of the first dielectric substrate 5 is equivalently and gradually reduced toward the transmission direction 1A of the dielectric waveguide line 1. According to the above configuration, an electric field vector in the longitudinal direction in the dielectric waveguide line 1 can be smoothly converted into an electric field vector in the lateral direction in the rectangular waveguide 2. Thus, more efficient transmission can be performed.

The configuration in which the depth D of each the plurality of recesses 15 is gradually increased as described above can be applied to the above-described first to fifth example embodiments. In particular, when the plurality of recesses 15 include the plurality of cylindrical recesses 15*d*, the depth D of each the plurality of cylindrical recesses 15*d* as shown in FIG. 7 is gradually changed. It is desirable that depth D of each of the plurality of cylindrical recesses 15*d* be increased stepwise, in order to prevent the thickness of the first dielectric substrate 5 from changing suddenly toward the transmission direction 1A of the dielectric waveguide line 1. By doing so, it is expected that stress can be reduced in the first dielectric substrate 5, more specifically, the mechanical strength can be improved in the first dielectric substrate 5.

Seventh Example Embodiment

Figure 9:
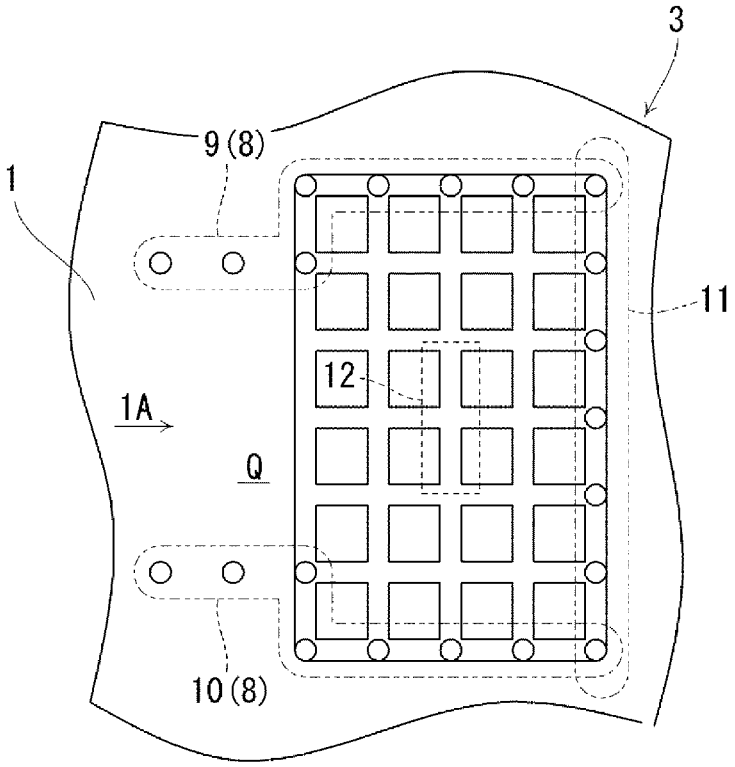
FIG. 9 is a plan view of a connection structure according to a seventh example embodiment.

Next, a seventh example embodiment will be described with reference to FIG. 9. Hereinafter, a difference between this example embodiment and the first example embodiment will be mainly described, and the repeated description will be omitted.

In this example embodiment, the distance between the first via hole group 9 and the second via hole group 10 is locally increased in the vicinity of the coupling window 12. That is, the lateral dimension of the transmission region Q is locally increased in the vicinity of the coupling window 12. With such a configuration, a resonator is formed in the vicinity of the coupling window 12, thereby making it possible to increase the bandwidth of the transmission characteristic.

(Effectiveness Demonstration Test Report)

Figure 10:
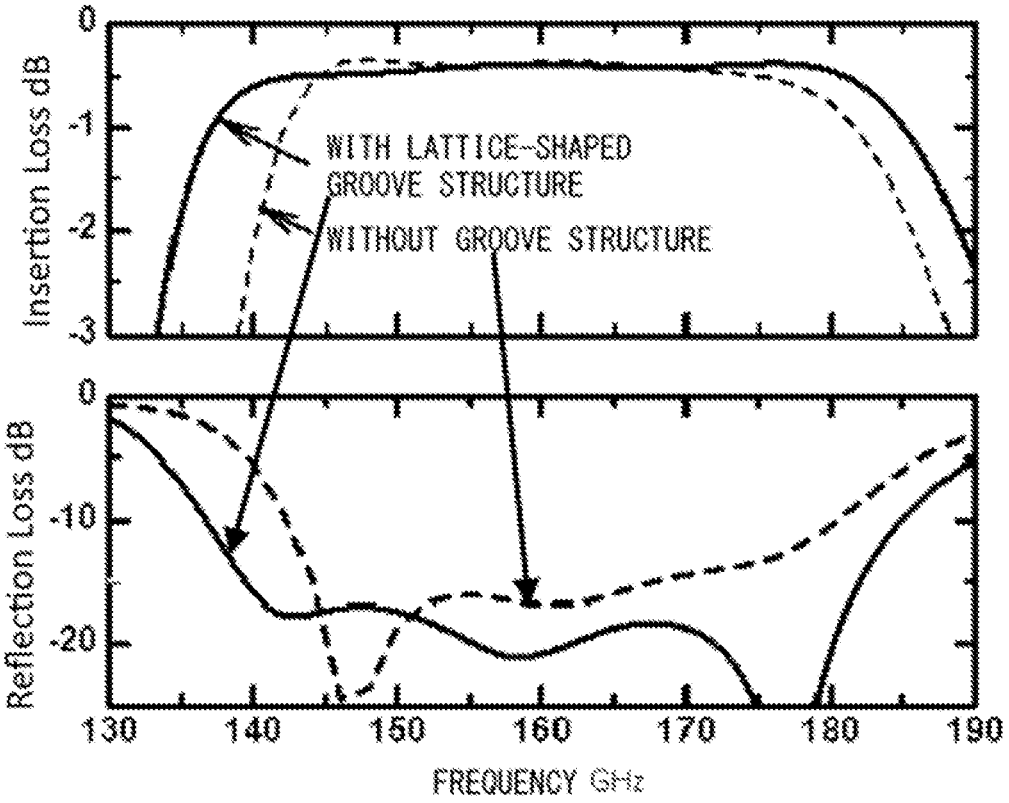
FIG. 10 is a graph showing an improvement in transmission characteristics because of the connection structure.

Next, a result of a test conducted to verify the improvement effect of the transmission characteristics by the connection structure 3 is shown below. FIG. 10 is a graph showing the improvement effect of the transmission characteristics by the connection structure 3 as shown in FIG. 9. In this graph, a result of an electromagnetic field analysis of the transmission characteristics when the plurality of recesses 15 are formed in the lattice shape (with a lattice groove structure) in an optimized structure are compared with that of an electromagnetic field analysis of the transmission characteristics when the plurality of recesses 15 are not formed (without groove structure) in an optimized structure. The vertical axes show the insertion and reflection losses in dB, while the horizontal axis of each graph shows the frequency in GHz. In each graph, the solid line shows the result for the lattice shape, and the dashed line shows the result for the other.

In FIG. 1, the thickness 5T of the first dielectric substrate 5 was 0.35 mm, which was sufficiently strong in an actual trial production. The diameter of a number of via holes constituting the two arrays of via hole groups 8 was 0.1 mm, the pitch of the via holes was 0.2 mm, and the clearance distance between the two arrays of via hole groups 8 was 0.75 mm. The depth D of each of the plurality of optimized recesses 15 was 0.075 mm, the spacing between the plurality of transmission-direction translational recesses 15*a* was 0.2 mm, and the spacing between the plurality of transmission-direction orthogonal recesses 15*b* was 0.3 mm. In addition, the resonator structure shown in the seventh example embodiment was optimized and employed in both cases where the plurality of recesses 15 are provided in the first dielectric substrate 5 and where the plurality of recesses 15 are not provided in the first dielectric substrate 5. According to FIG. 10, by providing the plurality of recesses 15 in the first dielectric substrate 5, it was confirmed that a wider band and satisfactory transmission characteristics were obtained. Specifically, as apparently seen in FIG. 10, by providing the plurality of recesses 15 in the first dielectric substrate 5, less insertion loss and less reflection loss over a wider frequency band can be obtained compared to the case where the plurality of recesses 15 in the first dielectric substrate 5 are not provided. Note that the distance 5S between the bottom surfaces of the plurality of optimized recesses 15 and the second substrate surface 5*b* is affected by the size of the resonator structure, the uniformity of the function of the bottom surfaces of the recesses 15 as the upper surface of the waveguide, the coupling window 12, and so on. Therefore, the distance 5S in the optimized structure does not have to be exactly ¼ of the guide wavelength.

Eighth Example Embodiment

Next, an eighth example embodiment will be described with reference to FIG. 11. Hereinafter, a difference between this example embodiment and the first example embodiment will be mainly described, and the repeated description will be omitted.

Figure 11:
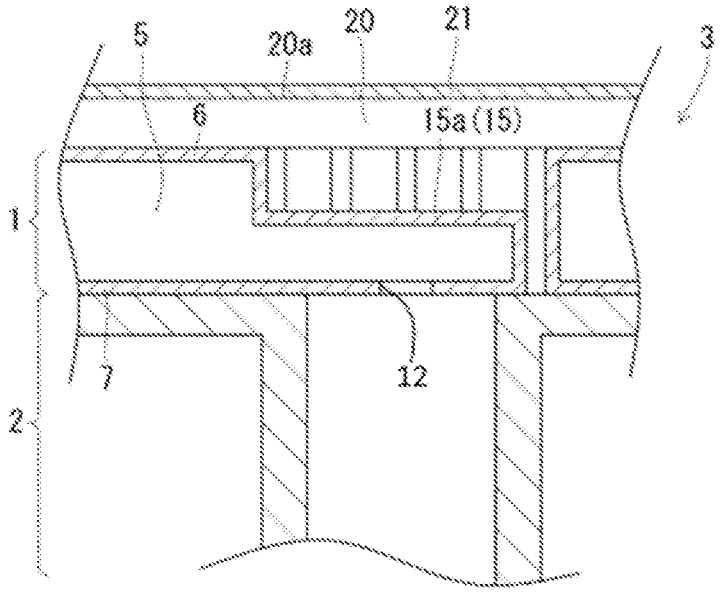
FIG. 11 is a cross-sectional view of a connection structure according to an eighth example embodiment.

As shown in FIG. 11, a plurality of recesses 15 are formed in the first dielectric substrate 5 in the vicinity of the coupling window 12. In other words, the first dielectric substrate 5 includes a part where the plurality of recesses 15 are not formed in the vicinity of the coupling window 12.

Another substrate may be laminated on this part. Thus, in this example embodiment, a second dielectric substrate 20 is laminated on the first dielectric substrate 5, regardless of whether or not it is in the vicinity of the coupling window 12. To be more specific, the second dielectric substrate 20 is laminated on the first conductor layer 6, regardless of whether or not it is in the vicinity of the coupling window 12. A third conductor layer 21 is formed on the upper surface 20*a* of the second dielectric substrate 20 opposite to the first dielectric substrate 5. The dielectric waveguide line 1 and the second dielectric substrate 20 are electrically and completely separated by the first conductor layer 6. Therefore, the third conductor layer 21 can be used to form a microstrip line or a coplanar line. When the third conductor layer 21 is used to constitute a microstrip line, the first conductor layer 6, the second dielectric substrate 20, and the third conductor layer 21 are used. When the third conductor layer 21 is used to constitute a coplanar line, the second dielectric substrate 20 and the third conductor layer 21 are used. An IC or the like may be mounted using the third conductor layer 21.

The second dielectric substrate 20 may be quartz. However, since quartz is highly rigid and easily cracked, the lamination of quartz is difficult. For this reason, it is desirable that a sheet made of a resin material having low rigidity and having a small load on the first dielectric substrate 5 such as polyimide be attached to the first conductor layer 6 to constitute the second dielectric substrate 20. In this example embodiment, the second dielectric substrate 20 can be supported on the first dielectric substrate 5 periodically in the coupling window 12, so that even if the second dielectric substrate 20 has low rigidity, the second dielectric substrate 20 is hard to bend and the flatness of the second dielectric substrate 20 can be ensured.

A separate conductor layer may be formed on a lower surface of the second dielectric substrate 20, which faces the plurality of recesses 15. In this case, even if the transmission line formed in the third conductor layer 21 is formed across the recesses 15, continuity as a transmission line can be ensured.

Although the preferred example embodiments of the present disclosure have been described above, the above example embodiments can be modified as follows.

That is, the pitch of the plurality of transmission-direction translational recesses 15*a*, the pitch of the plurality of transmission-direction orthogonal recesses 15*b*, the pitch of the plurality of transmission-direction oblique recesses 15*c*, and the pitch of the plurality of cylindrical recesses 15*d* can be appropriately changed. The length and width of the transmission-direction translational recess 15*a*, the transmission-direction orthogonal recess 15*b*, and the transmission-direction oblique recess 15*c* can also be appropriately changed. As shown in FIGS. 1 and 4, in the vicinity of the coupling window 12, the transmission-direction orthogonal recesses 15*b* are formed so as to connect the via hole 9*a* to the via hole 10*a*, but the transmission-direction orthogonal recess 15*b* may not be connected to the via hole 9*a* or the via hole 10*a*.

The two arrays of via hole groups 8 are not necessarily formed in a straight line. Outer peripheral ends of the plurality of lattice-shaped recesses 15 need not be rectangular. At least one of the recesses 15 may protrude outside the two arrays of via hole groups 8. The coupling window 12 may be rectangular, circular, or other polygonal.

In each of the above example embodiments, a plurality of recesses 15 are formed only in the vicinity of the coupling window 12. Alternatively, the plurality of recesses 15 may be formed in a part away from the coupling window 12. In this case, when the operating frequency signal transmitted through the dielectric waveguide line 1 approaches the vicinity of the coupling window 12, a rapid change in the electromagnetic field distribution can be lessened.

The rectangular waveguide 2 employed in each of the above example embodiments may be replaced with a circular waveguide depending on the purpose. In this case, however, the operating band of the rectangular waveguide is narrower than that of a standard waveguide having a cross-sectional aspect ratio of 1:2.

In each of the above example embodiments, the first dielectric substrate 5 is made of quartz. However, instead of quartz, a dielectric substrate such as a ceramic substrate or a resin substrate may be used.

In each of the above example embodiments, the plurality of recesses 15 may be formed by, for example, router processing.

Although the present disclosure has been described above with reference to the example embodiments, the present disclosure is not limited by the above. Various changes in the structure and details of the present invention can be understood by a person skilled in the art within the scope of the invention.

This application is based upon and claims the benefit of priority from Japanese patent application No. 2018-106896, filed on Jun. 4, 2018, the disclosure of which is incorporated herein in its entirety by reference.

REFERENCE SIGNS LIST

1 DIELECTRIC WAVEGUIDE LINE
1A TRANSMISSION DIRECTION
2 RECTANGULAR WAVEGUIDE
2A TRANSMISSION DIRECTION
3 CONNECTION STRUCTURE
5 FIRST DIELECTRIC SUBSTRATE
5*a* FIRST SUBSTRATE SURFACE
5*b* SECOND SUBSTRATE SURFACE
6 FIRST CONDUCTIVE LAYER
7 SECOND CONDUCTIVE LAYER
8 VIA HOLE GROUP
9 FIRST VIA HOLE GROUP
9*a* VIA HOLE
10 SECOND VIA HOLE GROUP
10*a* VIA HOLE
11 THIRD VIA HOLE GROUP
11*a* VIA HOLE
12 COUPLING WINDOW
13 OPEN END SURFACE
15 RECESS
15*a* TRANSMISSION-DIRECTION TRANSLATIONAL RECESS
15*b* TRANSMISSION-DIRECTION ORTHOGONAL RECESS
15*c* TRANSMISSION-DIRECTION OBLIQUE RECESS
15*d* CYLINDRICAL RECESS
16 RECESS CONDUCTOR LAYER
20 SECOND DIELECTRIC SUBSTRATE
20*a* UPPER SURFACE
21 THIRD CONDUCTIVE LAYER

The invention claimed is:

1. A connection structure between a dielectric waveguide line and a waveguide, the dielectric waveguide line comprising:

a first dielectric substrate including a first substrate surface and a second substrate surface opposite to the first substrate surface;

a first conductor layer disposed on the first substrate surface;

a second conductor layer disposed on the second substrate surface; and two arrays of through conductor groups composed of a plurality of through conductors formed in a transmission direction of the dielectric waveguide line at spacings of ½ or less of a dielectric guide wavelength as a guide wavelength of a high-frequency signal in the dielectric waveguide line, the two arrays of through conductor groups electrically connecting the first conductor layer to the second conductor layer and being formed apart from each other in a direction orthogonal to the transmission direction, and a transmission region, in which the high-frequency signal propagates, being formed surrounded by the first conductor layer, the second conductor layer, and the two arrays of through conductor groups, wherein a coupling window is formed in the second conductor layer, the waveguide is disposed in such a way that an open end surface of the waveguide faces the coupling window, and that the transmission direction of the dielectric waveguide line becomes orthogonal to a transmission direction of the waveguide, a plurality of recesses are formed in the first substrate surface in the vicinity of the coupling window, and a recessed conductor layer electrically connected to the first conductor layer is formed on inner wall surfaces of the plurality of recesses.

2. The connection structure according to claim 1, wherein a distance between bottom surfaces of the plurality of recesses and the second substrate surface is ¼ of the dielectric guide wavelength.

3. The connection structure according to claim 1, wherein the plurality of recesses comprises at least one of:

a transmission-direction translational recess extending along the transmission direction of the dielectric waveguide line;

a transmission-direction orthogonal recess extending along a direction in which the two arrays of through conductor groups facing each other;

a transmission-direction oblique recess extending obliquely toward the transmission direction of the dielectric waveguide line when viewed in a direction in which the first substrate surface facing the second substrate surface; and a cylindrical recess extending in a shape of a cylinder from the first substrate surface toward the second substrate surface.

4. The connection structure according to claim 3, wherein when the plurality of recesses include the transmission-direction translational recesses, the plurality of transmission-direction translational recesses are formed parallel to each other, and the plurality of transmission-direction translational recesses are formed at spacings of ½ or less of the dielectric guide wavelength, and when the plurality of recesses include the transmission-direction orthogonal recesses, the plurality of transmission-direction orthogonal recesses are formed parallel to each other, and the plurality of transmission-direction orthogonal recesses are formed at spacings of ½ or less of the dielectric guide wavelength.

5. The connection structure according to claim 3, wherein the plurality of recesses include the plurality of transmission-direction translational recesses and a plurality of transmission-direction orthogonal recesses, and the plurality of transmission-direction translational recesses and the plurality of transmission-direction orthogonal recesses are formed in a lattice shape.

6. The connection structure according to claim 3, wherein the plurality of recesses include the plurality of the transmission-direction oblique recesses, and the plurality of transmission-direction oblique recesses are formed in a lattice shape.

7. The connection structure according to claim 1, wherein a depth of each of the plurality of recesses increases toward the transmission direction of the dielectric waveguide line.

8. The connection structure according to claim 1, wherein a second dielectric substrate is laminated on the first conductor layer, a third conductor layer is formed on a surface of the second dielectric substrate opposite to the first conductor layer, and a microstrip line is composed of the first conductor layer, the second dielectric substrate, and the third conductor layer.

9. The connection structure according to claim 1, wherein a second dielectric substrate is laminated on the first conductor layer, a third conductor layer is formed on a surface of the second dielectric substrate opposite to the first conductor layer, and a coplanar line is composed of the second dielectric substrate and the third conductor layer.

* * * * *